United States Patent [19]

Jackson et al.

[11] Patent Number: 4,519,840

[45] Date of Patent: May 28, 1985

[54] HIGH STRENGTH, WEAR AND CORROSION RESISTANT COATINGS

[75] Inventors: John E. Jackson, Brownsburg; Thomas A. Adler, Indianapolis; Jean M. Quets, Indianapolis; Robert C. Tucker, Jr., Brownsburg, all of Ind.

[73] Assignee: Union Carbide Corporation, Danbury, Conn.

[21] Appl. No.: 546,480

[22] Filed: Oct. 28, 1983

[51] Int. Cl.[3] ..... C09D 5/00

[52] U.S. Cl. ..... 106/1.05; 75/252; 75/255; 106/14.05; 420/431; 428/546; 428/551

[58] Field of Search ..... 427/34, 423; 420/431; 106/1.05, 1.12, 14.05; 75/252, 255; 428/546, 551

[56] References Cited

U.S. PATENT DOCUMENTS

| | | | |
|---|---|---|---|
| 2,714,563 | 8/1955 | Poorman et al. | 264/121 |
| 2,858,411 | 10/1958 | Gage | 219/75 |
| 2,950,867 | 8/1960 | Hawley et al. | 239/13 |
| 3,016,447 | 1/1962 | Gage et al. | 427/37 |
| 3,419,415 | 12/1968 | Dittrich | 427/423 |
| 3,914,507 | 10/1975 | Fustukian | 428/404 |
| 4,173,685 | 11/1979 | Weatherly | 427/34 |

*Primary Examiner*—Lorenzo B. Hayes

*Attorney, Agent, or Firm*—John R. Doherty

[57] ABSTRACT

A coating composition applied to a substrate by a thermal spray process which consists essentially of from about 11.0 to about 18.0 weight percent cobalt, from about 2.0 to about 6.0 weight percent chromium, from about 3.0 to about 4.5 weight percent carbon and the balance tungsten.

12 Claims, No Drawings

HIGH STRENGTH, WEAR AND CORROSION RESISTANT COATINGS

DESCRIPTION

1. Copending Applications

Copending application Serial No. 546,542, of J. E. Jackson et al. entitled "Wear and Corrosion Resistant Coatings and Method for Producing the Same", and copending application Serial No. 546,541 of C. H. Londry et al. entitled "Wear and Corrosion Resistant Coatings Applied at High Deposition Rates", both filed on even date herewith, disclose and claim subject matter which is related to the present application.

2. Technical Field

The present invention relates to wear and corrosion resistant coatings and to a method for producing such coatings. More particularly, the invention relates to a new family of W-Co-Cr-C coatings having improved strength and toughness.

BACKGROUND ART

Coatings of W-Co-Cr-C are used in those applications where both superior wear and corrosion resistance are required. A typical composition for these coatings comprises about 8 to 10 weight percent cobalt, about 3 to 4 weight percent chromium, about 4.5 to 5.5 weight percent carbon and the balance tungsten. These coatings can be successfully applied to various substrates, e.g., iron base alloy substrates, using known thermal spray techniques. Such techniques include, for example, detonation gun (D-Gun) deposition as disclosed in U.S. Pat. Nos. 2,714,563 and 2,950,867, plasma arc spray as disclosed in U.S. Pat. Nos. 2,858,411 and 3,016,447, and other so-called "high velocity" plasma or "hypersonic" combustion spray processes.

Although coatings of W-Co-Cr-C have been employed successfully in many industrial applications over the past decade or more, there is an ever increasing demand for even better coatings having superior toughness and strength. In the petrochemical industry, for example, there is a need for special coatings of this type for use on gate valves employed in deep well service equipment for handling highly corrosive fluids under hydraulic pressures exceeding 10,000 psi.

As is generally known, coatings of W-Co-Cr-C derive their toughness and strength from the presence of cobalt and their wear resistance from the formation of complex carbides of W, Co and Cr. Corrosion resistance is related to the amount of chromium employed in the coating. However, an excessive amount of chromium tends to decrease the toughness of the coating and should be avoided.

It is also known that the wear resistance of these coatings will generally increase with an increase in the amount of carbon and/or chromium employed in the coating. On the contrary, however, it is known as well that wear resistance tends to decrease with any increase in the cobalt content. A typical coating composition is therefore selected as a compromise to provide good wear resistance with adequate toughness and strength for many applications.

SUMMARY OF THE INVENTION

It has now been surprisingly discovered in accordance with the present invention that increasing the cobalt content of the W-Co-Cr-C coatings described above up to about 18 weight percent with the proper proportions of both carbon and chromium actually produces about three times the toughness and strength without at the same time substantially decreasing the wear resistance of the coating.

A coating composition in accordance with the present invention consists essentially of from about 11.0 to about 18.0 weight percent cobalt, from about 2.0 to about 6.0 weight percent chromium, from about 3.0 to about 4.5 weight percent carbon and the balance tungsten.

DESCRIPTION OF THE PREFERRED EMBODIMENTS

The coatings of the present invention can be applied to a substrate using any conventional thermal spray technique. The preferred method of applying the coating is by detonation gun (D-Gun) deposition. A typical D-Gun consists essentially of a water-cooled barrel which is several feet long with an inside diameter of about 1 inch. In operation, a mixture of oxygen and a fuel gas, e.g., acetylene, in a specified ratio (usually about 1:1) is fed into the barrel along with a charge of powder to be coated. The gas is then ignited and the detonation wave accelerates the powder to about 2400 ft./sec. (730 m/sec.) while heating the powder close to or above its melting point. After the powder exits the barrel, a pulse of nitrogen purges the barrel and readies the system for the next detonation. The cycle is then repeated many times a second.

The D-Gun deposits a circle of coating on the substrate with each detonation. The circles of coating are about 1 inch (25 mm) in diameter and a few ten thousandths of an inch (microns) thick. Each circle of coating is composed of many overlapping microscopics splats corresponding to the individual powder particles. The overlapping splats interlock and mechanically bond to each other and the substrate without substantially alloying at the interface thereof. The placement of the circles in the coating deposition are closely controlled to build-up a smooth coating of uniform thickness to minimize substrate heating and residual stresses in the applied coating.

The powder used in producing the coating of the present invention is chosen to achieve the particular coating composition desired using a given set of deposition parameters. Preferably, the oxygen-fuel gas mixture ratio employed in the D-Gun process is maintained at about 1.0. It is also possible to use other operating conditions with a D-Gun and still obtain the desired coating composition if the powder composition is adjusted accordingly. Moreover, other powder compositions may be used with other thermal spray coating devices to compensate for changes in composition during deposition and obtain the desired coating composition of this invention.

The powders used in the D-Gun for applying a coating according to the present invention are preferably cast and crushed powders. However, other forms of powder such as sintered powders can also be used. Generally, the size of the powders should be about −325 mesh. Powders produced by other methods of manufacture and with other size distributions may be used according to the present invention with other thermal spray deposition techniques if they are more suited to a particular spray device and/or size.

A typical powder composition for depositing a coating according to the present invention consists essentially of from about 11.5 to about 14.5 weight percent cobalt, from about 1.5 to about 5.5 weight percent chromium, from about 4.0 to about 5.5 weight percent carbon and the balance tungsten. In this powder composition, some of the carbon may be uncombined carbon, e.g., up to about 1.0 weight percent, which may be lost in the deposition process. The feed rate of both oxygen and fuel gas (e.g., acetylene) should be adjusted with this powder to provide an oxy-fuel gas ratio of about 1.0. This is the same ratio that has been used to deposit conventional coatings of the prior art.

Alternatively, the coating of the present invention can be applied to a substrate by plasma arc spray or other thermal spray techniques. In the plasma arc spray process, an electric arc is established between a non-consumable electrode and a second non-consumable electrode spaced therefrom. A gas is passed in contact with the non-consumable electrode such that it contains the arc. The arc-containing gas is constricted by a nozzle and results in a high thermal content effluent. Powdered coating material is injected into the high thermal content effluent nozzle and is deposited onto the surface to be coated. This process, which is described in U.S. Pat. No. 2,858,411, supra, produces a deposited coating which is sound, dense and adherent to the substrate. The applied coating also consists of irregularly shaped microscopic splats or leaves which are interlocked and mechanically bonded to one another and also to the substrate.

In those cases where the plasma arc spray process is used to apply the coatings in the present invention, powders fed to the arc torch may have essentially the same composition as the applied coating itself. With some plasma arc or other thermal spray equipment, however, some change in composition is to be expected and in such cases, the powder composition may be adjusted accordingly to achieve the coating composition of the present invention.

The coatings of the present invention may be applied to almost any type of substrate, e.g., metallic substrates such as iron or steel or non-metallic substrates such as carbon, graphite or polymers, for instance. Some examples of substrate material used in various environments and admirably suited as substrates for the coatings of the present invention include, for example, steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals and refractory-metal base alloys.

Although the composition of the coatings of the present invention may vary within the ranges indicated above, the preferred coating composition consists essentially of from about 14.0 to about 18.0 weight percent cobalt, from about 2.0 to about 5.5 weight percent chromium, from about 3.0 to about 4.5 weight percent carbon and the balance tungsten.

The microstructure of the coatings of the present invention are very complex and not completely understood. However, the major and some of the minor phases of both the powder and coating composition have been identified using essentially three techniques: (1) X-ray diffraction, (2) metallography, and (3) scanning electron microscopy (SEM). X-ray diffraction identifies the phases and gives an estimate of their volumetric amounts. However, some of the phases present in smaller amounts are not observed with X-ray diffraction. The following phases were identified with X-ray diffraction:

Powder

Major: $W_2C$

Minor: Hexagonal WC, $CoW_3C$ and Eta (either $M_{12}C$ or $M_6C$ with M=W, Co and/or Cr)

Coating

Major: $W_2C$

Minor: Cubic WC

Because of their unique toughness and strength, coatings of the present invention are ideally suited for use on gate valves employed in well service equipment for handling highly corrosive fluids (e.g., solutions containing chlorides, carbon monoxide, carbon dioxide, hydrogen sulfide, vanadium salts, etc.) under high hydraulic pressures, typically about 15,000 psi, and temperatures above 200° F. In the past, conventional coatings failed under these conditions mostly due to their relatively low tensile strength.

The mechanism of these failures is believed to be as follows: At high pressures and at sufficiently high temperatures, the pressurized fluid slowly diffuses through the thickness of the coating and accumulates within the porosity of the coating. During this phase, the coating is in compression and resists quite well the ambient pressure. After a certain time, the pressure within the porosity reaches a value equal to the ambient pressure, and the inward diffusion of fluid stops. As long as the pressure is maintained, the coating is not subjected to any unusual stresses.

Once the ambient pressure is released, however, the pressure within the porosity is no longer balanced by the ambient pressure. Before the pressurized fluid within the porosity has had time to diffuse out of the coating, the coating is stressed or loaded from within itself. If the internal specific load in the coating exceeds the fracture stress of the coating, the coating will fail outwardly from within the coating.

To satisfy the stringent requirements for gate valves subjected to high pressures and temperatures, it is imperative that stronger coatings be provided while still maintaining all of the normal requirements for gate valve coatings, such as wear and corrosion resistance.

Typically, coatings containing tungsten carbide, cobalt or nickel, and chromium have shown a low resistance to the type of failures described above and a low strength when loaded hydraulically in an outward direction from the interface. However, these coatings have shown a good resistance to wear and corrosion. On the other hand, coatings containing tungsten carbide and cobalt, but devoid of any chromium, have shown a good resistance to failure and a high strength when subjected to high internal pressures. Because of their lack of chromium, however, these coatings provide little or no resistance to corrosion. The addition of chromium to the coating may increase its resistance to corrosion but at the cost of lowering the strength of the coating to the point where the coating will fail when subjected to high internal pressures.

The coating of the present invention represents a significant and totally unexpected improvement over the prior art. The coating incorporates not only enough chromium to provide corrosion resistance but also enough cobalt, tungsten and carbon in appropriate relative proportions to exhibit more than twice the toughness and strength of prior coatings without at the same time significantly reducing wear resistance. Although the exact reasons for improved toughness and strength are not clearly understood, it is believed that they result from a change in chemistry and accompanying phase changes in the coating.

The following examples will serve to further illustrate the practice of the present invention.

EXAMPLE I

Specimens of AISI 1018 steel were cleaned and prepared for coating as follows: The surface on one side of each specimen was ground smooth and parallel to the opposite side. The surface was then grit blasted with 60 mesh $Al_2O_3$ to a surface roughness of about 120 microinch RMS. Three specimens were set aside and prepared for hydraulic pressure test as follows: On the side to be coated, eight small holes, 0.020 inch (0.51 mm) in diameter, were drilled in the specimen substrate perpendicular to its surface to a depth of a few tenths of an inch (a few mm). The holes were then enlarged so as to accommodate leak tight couplings. Piano wires, 0.020 inch (0.51 mm) in diameter, were then inserted through the couplings into the small holes and firmly secured so their ends were even and provided a smooth continuation with the surface to be coated. All the specimens were then coated according to the prior art using a detonation gun (D-Gun) and a sintered powder of the following composition: 10 weight percent Co, 4 weight percent Cr, 5.2 weight percent C, and the balance W. The size of the powders was about −325 mesh. Acetylene was used as the fuel-gas. The oxy-fuel gas ratio was 0.98.

A chemical analysis of the coating showed the following composition: 8 weight percent Co, 3.2 weight percent Cr, 4.7 weight percent C and the balance W. The chemical analysis was carried out principally by two methods. Carbon was analyzed by a combustion analysis technique using a Leco Carbon Analyzer and volumetric determination of gaseous output. Cobalt and chromium were analyzed by first fusing the sample in $Na_2O_2$ and separating the cobalt and chromium, then determining the amount of each potentiometrically.

The mechanical strength of the coating was determined by an hydraulic pressure test as follows: After coating the specimen prepared for this test in the manner described above, the piano wires were carefully removed providing cavities directly under the coating. By means of the couplings, the cavities were then connected to an hydraulic pressure system and the cavities filled with an hydraulic fluid. The fluid was then pressurized, loading the coating from the interface outward until failure of the coating occurred. Eight measurements were made on each coating and the average value defined as the failure pressure. The failure pressure was taken to be a measure of the coating mechanical strength for the specific coating thickness. The failure pressures can then be used to rank different coatings of basically the same thickness. The failure pressures for these particular specimens were 5,400 psi at a thickness of 0.0044 inch, 10,300 psi at a thickness of 0.0083 inch and 13,200 psi at 0.0105 inch. Linear regression predicts a failure pressure of 8,300 psi for a 0.0067 inch thick coating.

Abrasive wear properties of the applied coating were also determined using the standard dry sand/rubber wheel abrasion test described in ASTM Standard G65-80, Procedure A. In this test, the coated specimens were loaded by means of a lever arm against a rotating wheel with a chlorobutyl rubber rim around the wheel. An abrasive (i.e., 50–70 mesh Ottawa Silica Sand) was introduced between the coating and the rubber wheel. The wheel was rotated in the direction of the abrasive flow. The test specimen was weighed before and after the test and its weight loss was recorded. Because of the wide differences in the densities of different materials tested, the mass loss is normally converted to volume loss to evaluate the relative ranking of materials. The average volume loss for the coated specimens tested (conventional W-Co-Cr-C coating) was 1.7 $mm^3$ per 1,000 revolutions.

The hardness of the coatings was also measured by standard methods. The average hardness was found to be 1100 $DPH_{300}$.

EXAMPLE II

Specimens of AISI 1018 steel, including one specimen for the hydraulic pressure test, were prepared in the same manner as described in Example I. The specimen surfaces were then coated using a D-Gun and a cast and crushed powder of the following composition: 14.1 weight percent Co, 4.8 weight percent Cr, 4.2 weight percent C and the balance W. The powder size was −325 mesh. Acetylene was also used as the fuel gas. The oxy-fuel gas ratio in the D-Gun was 0.98.

A chemical analysis of the coating was performed using the same methods described in Example I. The analysis showed the following composition: 16.5 weight percent Co, 4.9 weight percent Cr, 3.7 weight percent C and the balance W.

The mechanical strength of the coating was determined using the same hydraulic pressure test. The failure pressure for this particular coating was 27,900 psi at a thickness of 0.0068 inch. This represents more than a threefold improvement in strength as compared to the coating tested in Example I.

Abrasive wear tests were also carried out using the ASTM Standard G65-80, Procedure A. The average volume loss for the specimens was 1.8 $mm^3$ per 1,000 revolutions. The wear properties were approximately equivalent to those of the specimens in the previous example.

The hardness of the coating was also measured and found to be 1000 $DPH_{300}$.

EXAMPLE III

Specimens of AISI 1018 steel, including one specimen for the hydraulic pressure test, were prepared in the same manner as described in Example I. The specimen surfaces were then coated using a D-Gun and a cast and crushed powder of the following composition: 12.0 weight percent Co, 2.1 weight percent Cr, 4.9 weight percent C and the balance W. The powder size was −325 mesh. Acetylene was also used as the fuel gas. The oxy-fuel gas ratio in the D-Gun was 0.98.

A chemical analysis of the coating was performed using the same methods as described in Example I. The analysis showed the following composition: 17.9 weight percent Co, 2.8 weight percent Cr, 4.1 weight percent C and the balance W.

The same hydraulic pressure test was employed to determine the mechanical strength of the coating. The failure pressure for this particular coating was 26,500 psi at a thickness of 0.0067 inch. This represents more than a threefold improvement in strength as compared to the coating tested in Example I.

Abrasive wear tests were also carried out using the ASTM Standard G65-80, Procedure A. The average volume loss for the specimens was 3.6 $mm^3$ per 1000 revolutions. The wear properties of this coating were not as good as those for the coating tested in the previous example. However, the wear resistance was still acceptable.

The hardness of the coating was also measured and found to be 1000 $DPH_{300}$.

EXAMPLE IV

Specimens of AISI 1018 steel, including two specimens for the hydraulic pressure test, were prepared in the same manner as described in Example I. The specimen surfaces were then coated using a D-Gun and a cast and crushed powder of the following composition: 12.8 weight percent Co, 3.9 weight percent Cr, 4.4 weight percent C and the balance W. The powder size was −325 mesh. Acetylene was also used as the fuel gas. The oxy-fuel gas ratio in the D-Gun was 0.98.

A chemical analysis of the coating was performed using the same methods as described in Example I. The analysis showed the following composition: 14.4 weight percent Co., 4.3 weight percent Cr, 3.7 weight percent C and the balance W.

The same hydraulic pressure test was employed to determine the mechanical strength of the coating. The failure pressure for these particular coatings was 22,200 psi at a thickness of 0.0067 inch. This represents about a threefold improvement in strength as compared to the coating tested in Example I.

Abrasive wear tests were also carried out using the ASTM Standard G65-80, Procedure A. The average volume loss for the specimens was 1.8 $mm^3$ per 1000 revolutions.

The hardness of the coatings was also measured and found to be 1060 $DPH_{300}$.

EXAMPLE V

Specimens of AISI 1018 steel, including one specimen for the hydraulic pressure test, were prepared in the same manner as described in Example I. The specimen surfaces were then coated using a plasma spray torch and a conventional sintered powder of the following composition: 10 weight percent Co, 4 weight percent Cr, 5.2 weight percent C and the balance W. The powder size was also −325 mesh.

A chemical analysis of the coating was performed using the same methods as described in Example I. The analysis showed the following composition: 9.2 weight percent Co, 3.5 weight percent Cr, 5.0 weight percent C and the balance W.

The same hydraulic pressure test was employed to determine the mechanical strength of the coating. The failure pressure for this particular coating was 9,600 psi at a thickness of 0.0069 inch. Seven measurements were made on this coating instead of eight.

Abrasive wear tests were also carried out using the ASTM Standard G65-80, Procedure A. The average volume loss for the specimen was 9.3 $mm^3$ per one thousand revolutions. The wear properties of this coating were poor even when compared against the wear properties of the conventional D-Gun coatings of Example I. This is to be expected in the case of plasma spray coatings which do not wear as well as D-Gun coatings.

The hardness of the specimen was also measured and found to be 687 $DPH_{300}$.

EXAMPLE VI

Specimens of AISI 1018 steel, including one specimen for the hydraulic pressure test, were prepared in the same manner as described in Example I. The specimen surfaces were then coated using a plasma spray torch and a cast and crushed powder of the following composition: 14.1 weight percent Co, 4.8 weight percent Cr, 4.2 weight percent C and the balance W. This was the same powder mixture used in preparing the coatings of Example II. The powder size was also the same, i.e., −325 mesh.

A chemical analysis of the coating was performed using the same methods as described in Example I. The analysis showed the following composition: 13.9 weight percent Co, 4.3 weight percent Cr, 3.2 weight percent C and the balance W.

The same hydraulic pressure test was employed to determine the mechanical strength of the coating. The failure pressure for this particular coating was 11,300 psi at a thickness of 0.0063 inch.

Abrasive wear tests were also carried out using the ASTM Standard G65-80, Procedure A. The average volume loss for the coated specimen was 4.5 $mm^3$ per 1000 revolutions. The wear rate for this coating was half the wear rate for the plasma spray coating of the previous example using a conventional powder mixture.

The hardness of the coating was also measured and found to be 867 $DPH_{300}$.

EXAMPLE VII

Specimens of AISI 1018 steel, including one specimen for the hydraulic pressure test, were prepared in the same manner as described in Example I. The specimen surfaces were coated using a plasma spray torch and a cast and crushed powder of the following composition: 12.8 weight percent Co, 3.9 weight percent Cr, 4.4 weight percent C and the balance W. The powder was similar to that used in preparing the coatings in Example IV. The powder size was also −325 mesh.

A chemical analysis of the coating was performed using the same methods as described in Example I. The analysis showed the following composition: 11.3 weight percent Co, 3.5 weight percent Cr, 3.4 weight percent C and the balance W.

The same hydraulic pressure test was employed to determine the mechanical strength of the coating. The failure pressure for this particular coating was 10,500 psi at a thickness of 0.0061 inch.

Abrasive wear tests were also carried out using the ASTM Standard G65-80, Procedure A. The average volume loss for the coated specimens was 5.8 $mm^3$ per 1000 revolutions. The wear properties of this coating were not quite as good as those for the coating of the previous example, but they were significantly better than the plasma spray coatings of Example V using a conventional powder mixture.

The hardness of the coatings was also measured and found to be 795 $DPH_{300}$.

EXAMPLE VIII

Specimens of AISI 1018 steel, including one specimen for the hydraulic pressure test, were prepared in the same manner as described in Example I. The specimen surfaces were then coated using a D-Gun and a sintered powder of the following composition: 20.3 weight percent Co, 5.4 weight percent Cr, 5.2 weight percent C and the balance W. This powder was outside the scope of the present invention. The powder size was −325 mesh. Acetylene was also used as the fuel gas. The oxy-fuel gas ratio in the D-Gun was 0.98.

A chemical analysis of the coating was performed using the same methods as described in Example I. The analysis showed the following composition: 16.5 weight percent Co, 4.1 weight percent Cr, 4.8 weight percent C and the balance W. The carbon content of this coating was higher than that of the coatings of the present invention.

The same hydraulic pressure test was employed to determine the mechanical strength of the coating. The failure pressure for this particular coating was 10,600 psi at a thickness of 0.0067 inch. Seven measurements were taken on this coating instead of eight.

Abrasive wear tests were also carried out using the ASTM Standard G65-80, Procedure A. The average volume loss for the coated specimen was 4.8 $mm^3$ per 1000 revolutions.

The hardness of the coating was also measured and found to be 1040 $DPH_{300}$.

The coating was considered to be unacceptable because of low strength, high wear rate and cracking.

EXAMPLE IX

Specimens of AISI 1018 steel, including one specimen for the hydraulic pressure test, were prepared in the same manner as described in Example I. The specimen surfaces were then coated using a D-Gun and the same sintered powder used to prepare the coating in the previous example, but somewhat different deposition parameters were employed. The powder size was also −325 mesh. Acetylene was also used as the fuel gas. The oxy-fuel gas ratio in the D-Gun was 0.98.

A chemical analysis of the coating showed the following composition: 18.7 weight percent Co, 4.5 weight percent Cr, 4.9 weight percent C and the balance W. The cobalt and carbon content of this coating were both higher than that of the coatings of the present invention.

The same hydraulic pressure test was employed to determine the mechanical strength of the coating. The failure pressure for this particular coating was 8,700 psi at a thickness of 0.0060 inch.

Abrasive wear tests were also carried out using the ASTM Standard G65-80, Procedure A. The average volume loss for the specimen was 2.3 $mm^3$ per 1000 revolutions.

The hardness of the coating was also measured and found to be 1018 $DPH_{300}$.

Despite the fact that this coating exhibited a relatively good wear rate, the coating was considered unacceptable because of its low strength and cracking.

EXAMPLE X

Specimens of AISI 1018 steel, including a specimen for the hydraulic pressure test, were prepared in the same manner as described in Example I. The specimen surfaces were coated using a plasma spray torch and the same sintered powder used to prepare the coatings in the two previous examples. The powder size was also −325 mesh.

A chemical analysis of the coating showed the following composition: 18.5 weight percent Co, 4.6 weight percent Cr, 4.9 weight percent C and the balance W. The cobalt and carbon content of this coating were also both higher than that of the coatings of the present invention.

The same hydraulic pressure test was employed to determine the mechanical strength of the coating. The failure pressure test for this particular coating was 9,000 psi at a thickness of 0.0064 inch.

Abrasive wear tests were also carried out using the ASTM Standard G65-80, Procedure A. The average volume loss for the coated specimens was 6.3 $mm^3$ per 1000 revolutions.

The hardness of the coating was also measured and found to be 645 $DPH_{300}$.

This plasma deposited coating did not crack but had a higher wear rate than the coatings of this invention in Examples VI and VII.

EXAMPLE XI

Specimens of AISI 1018 steel, including one specimen for the hydraulic pressure test, were prepared in the same manner as described in Example I. The specimen surfaces were then coated using a D-Gun and a cast and crushed powder of the following composition: 24.3 weight percent Co, 9.1 weight percent Cr, 5.3 weight percent C and the balance W. The powder size was −325 mesh. Acetylene was used as the fuel gas. The oxy-fuel gas ratio in the D-Gun was 1.05.

A chemical analysis of the coating showed the following composition: 29.0 weight percent Co, 10.1 weight percent Cr, 3.5 weight percent C and the balance W. The cobalt and chromium content of this coating were both higher than that of the coatings of the present invention.

The same hydraulic pressure test was employed to determine the mechanical strength of the coating. The failure pressure for this particular coating was 23,800 psi at a thickness of 0.0070 inch. Seven measurements were made on this coating instead of eight.

Abrasive wear tests were also carried out using the ASTM Standard G65-80, Procedure A. The average volume loss for the specimen was 9.4 $mm^3$ per 1000 revolutions. The wear properties of this coating were poor as expected for coatings at this high cobalt content.

The hardness of the specimen was also measured and found to be 1000 $DPH_{300}$.

It will be seen from the foregoing that the present invention provides a new family of W-Co-Cr-C coatings having improved strength and toughness. The D-Gun coatings of this invention are capable of withstanding hydraulic pressures in excess of about 20,000 pounds per square inch at a coating thickness of about 0.006 inch. Even plasma coatings of this invention have lower wear rates than plasma coatings of the prior art. Moreover, the coatings can be applied at fast deposition rates without cracking or spalling.

Although the powder and coating compositions have been defined herein with certain specific ranges for each of the essential components, it will be understood that minor amounts of various impurities may also be present. Iron is usually the principal impurity in the coating resulting from grinding operations and may be present in amounts up to about 1.5 and in some cases 2.0 weight percent of the composition.

Although the foregoing examples include only D-Gun and plasma spray coatings, it will be understood that other thermal spray techniques such as "high velocity" plasma, "hypersonic" combustion spray processes or various other detonation devices may be used to produce coatings of the present invention.

We claim:

1. A coating composition applied to a substrate by a thermal spray process which consists essentially of from about 11.0 to about 18.0 weight percent cobalt, from about 2.0 to about 6.0 weight percent chromium, from about 3.0 to about 4.5 weight percent carbon and the balance tungsten.

2. A coating composition according to claim 1 consisting essentially of from about 14.0 to about 18.0 weight percent cobalt, from about 2.0 to about 5.5 weight percent chromium, from about 3.0 to about 4.5 weight percent carbon and the balance tungsten.

3. A coating composition according to claim 1 having a mechanical strength sufficient to withstand an hydraulic pressure in excess of about 20,000 pounds per square inch at a coating thickness of about 0.006 inch.

4. A coating composition according to claim 1 having a hardness value in excess of 900 $DPH_{300}$.

5. A coating composition according to claim 1 wherein the substrate is a metallic material selected from the group consisting of steel, stainless steel, iron base alloys, nickel, nickel base alloys, cobalt, cobalt base alloys, chromium, chromium base alloys, titanium, titanium base alloys, aluminum, aluminum base alloys, copper, copper base alloys, refractory metals, and refractory-metal base alloys.

6. A coating composition according to claim 1 wherein the substrate is a non-metallic material selected from the group consisting of carbon, graphite and polymers.

7. A powdered coating composition for applying a high strength, wear and corrosion resistant coating onto a substrate by a thermal spray process consisting essentially of from about 11.5 to about 14.5 weight percent cobalt, from about 1.5 to about 5.5 weight percent chromium, from about 4.0 to about 5.5 weight percent carbon and the balance tungsten.

8. A powdered coating composition according to claim 7 consisting of cast and crushed powders.

9. An article comprising a substrate and a coating applied to said substrate by a thermal spray process, said coating consisting essentially of from about 11.0 to about 18.0 weight percent cobalt, from about 2.0 to about 6.0 weight percent chromium, from about 3.0 to 4.5 weight percent carbon and the balance tungsten.

10. An article according to claim 9 wherein said coating consists essentially of from about 14.0 to about 18.0 weight percent cobalt, from about 2.0 to about 5.5 weight percent chromium, from about 3.0 to about 4.5 weight percent carbon and the balance tungsten.

11. An article comprising a substrate and a coating applied to said substrate by a thermal spray process, wherein said coating consists essentially of from about 11.0 to about 18.0 weight percent cobalt, from about 2.0 to about 6.0 weight percent chromium, from about 3.0 to 4.5 weight percent carbon and the balance tungsten, and wherein said coating has a hardness value in excess of 900 $DPH_{300}$ and a mechanical strength sufficient to withstand an hydraulic pressure in excess of about 20,000 pounds per square inch at a coating thickness of about 0.006 inch.

12. An article according to claim 11 wherein the major phase of said coating comprises $W_2C$ and wherein at least one minor phase of said coating comprises cubic WC.

* * * * *